United States Patent [19]

Danko

[11] 4,396,857

[45] Aug. 2, 1983

[54] ARC TUBE CONSTRUCTION

[75] Inventor: George K. Danko, Moreland Hills, Ohio

[73] Assignee: General Electric Company, Schenectady, N.Y.

[21] Appl. No.: 164,921

[22] Filed: Jul. 1, 1980

[51] Int. Cl.[3] ..... H01J 61/30; H01J 61/36

[52] U.S. Cl. ..... 313/634

[58] Field of Search ..... 313/220, 188, 317

[56] References Cited

U.S. PATENT DOCUMENTS

| | | | |
|---|---|---|---|
| 2,821,647 | 1/1958 | Rigden | 313/184 |
| 2,844,919 | 7/1958 | Power | 174/50.64 X |
| 2,848,641 | 8/1958 | Peterson et al. | 313/220 X |
| 3,324,332 | 6/1967 | Waymouth et al. | 313/220 |
| 3,390,298 | 6/1968 | Werner | 313/220 |
| 3,419,947 | 1/1969 | Gottschalk et al. | 313/220 X |
| 3,714,493 | 1/1973 | Fridrich | 313/184 |
| 3,878,421 | 4/1975 | Boehme | 313/220 |
| 3,939,538 | 2/1976 | Hellman et al. | 29/25.11 |
| 4,161,672 | 7/1979 | Cap et al. | 313/220 |

FOREIGN PATENT DOCUMENTS

| | | | |
|---|---|---|---|
| 50-39949 | 12/1975 | Japan | 313/220 |

*Primary Examiner*—Eugene R. La Roche

*Attorney, Agent, or Firm*—Ernest W. Legree; Philip L. Schlamp; Fred Jacob

[57] ABSTRACT

A vitreous arc tube is provided with constricted cylindrical neck portions intermediate the bulb portion proper and the pinched seals. The constricted necks may be formed as an incident in the blowing of the bulb out of quartz tubing. When the seal portions are pressed by the pinching jaws about the foliated inleads, the necks are maintained in substantially their original configuration and merely shrunk slightly about the inleads extending through them. An internal configuration is achieved which is substantially a surface of revolution and fin-effect is avoided.

8 Claims, 5 Drawing Figures

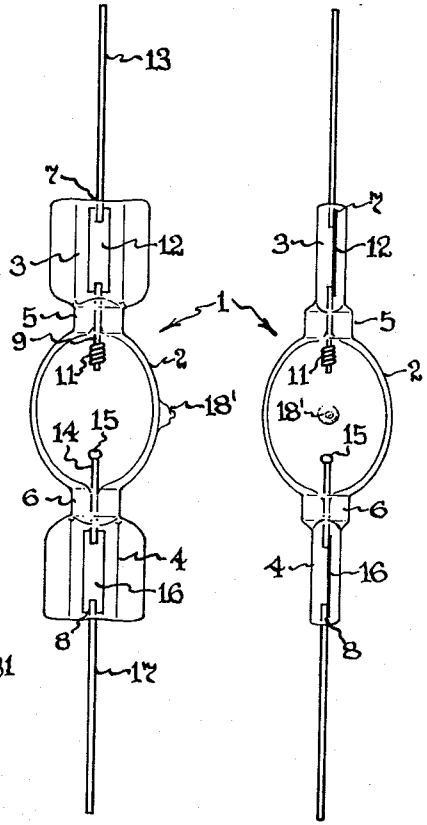
Fig. 1
Fig. 2
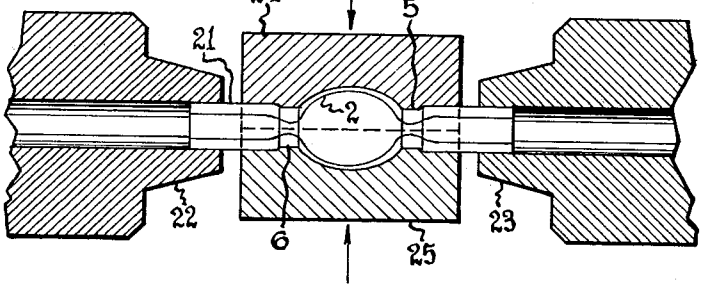
Fig. 3
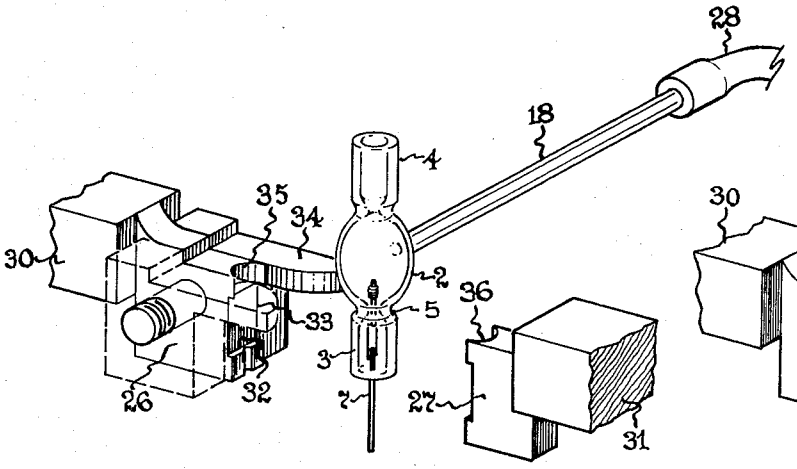
Fig. 4
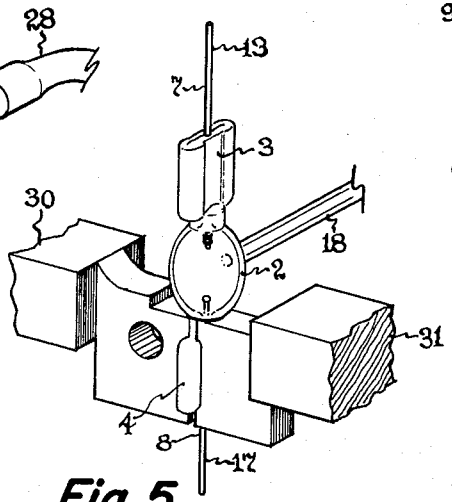
Fig. 5

ARC TUBE CONSTRUCTION

This invention relates to an arc tube construction and especially to a pinched end configuration which is particularly advantageous in miniature sizes of lamps.

BACKGROUND OF THE INVENTION

High pressure metal vapor lamps generally comprise an inner envelope or arc tube which is enclosed within a vitreous outer envelope or jacket. In metal halide lamps, the arc tube is of quartz or fused silica and contains a quantity of mercury along with one or more metallic halides and an inert starting gas. In commercial manufacture, the arc tubes have been commonly made utilizing so-called full pinch seals wherein the entire end segments of a piece of quartz tubing are flattened and sealed off. It is done by pressing the ends of the tube while in a heat-softened condition between a pair of opposed jaws to collapse the quartz about a foliated inlead supporting an electrode on its inner end. This results in a fin-like configuration resembling somewhat a fish's tail at each end of the arc tube.

When a metal halide lamp has reached a stable operating temperature, the mercury in the fill is substantially all vaporized but an excess of metal halide remains unvaporized. Such excess collects at cold spots within the arc chamber and these tend to be the ends or corners of the curved seam produced by the pinch. Such non-uniform condensation of the excess metal halide in flat-pinched arc tubes is often referred to as the fin-effect.

In U.S. Pat. No. 4,161,672—Cap and Lake, July 1979, the advantages of small inlead seals which have a low radiation-blocking or absorptive cross section are explained. They are particularly desirable in low wattage or miniature arc lamps in order to achieve high efficacy. One way of making a seal with a low absorptive cross section is by heating to a viscous state the seal portion of a preformed bulb, and vacuum-collapsing it onto the foil portion of an electrode inlead extending through it. Since in practice it is necessary to revolve the bulb as the neck is being heated and collapsed, the equipment required to seal arc tubes in this way is more elaborate and expensive than that required for pinch-sealing.

The object of this invention is to provide an arc tube configuration or design which achieves a low absorptive cross section and avoids fin-effect and which can be achieved through the use of pinching jaws. An ancillary object is to provide a convenient and economical method of manufacture for arc tubes of such configuration.

SUMMARY OF THE INVENTION

In accordance with my invention, the vitreous arc tube is provided with constricted cylindrical neck portions intermediate the bulb portion proper and the seal portions pinched and collapsed about the electrode in-leads. The cylindrical neck portions may be formed as part or incident in the blowing of the bulb out of quartz tubing, suitably through the use of an appropriate mold cavity. When subsequently the seal portions are heated and pressed by the pinching jaws to seal in the electrode inleads, the necks along with the bulb are maintained in substantially their original configuration and merely shrunk slightly about the inleads extending through them. Thus the arc tube passes from the rounded end configuration of the bulb or arc chamber through a cylindrical neck portion before taking the flattened seal shape. By so doing, an internal configuration is achieved which is substantially a surface of revolution about the longitudinal axis and fin-effect is avoided. Also by providing only a constricted throat or passage through the neck much greater accuracy is achieved in locating the electrodes within the bulb and in determining the electrode gap.

DESCRIPTION OF DRAWINGS

In the drawings:

FIGS. 1 and 2 are front and side elevation views to an enlarged scale of a miniature arc tube embodying the invention.

FIG. 3 shows a length of quartz tubing seized in a glass lathe for blowing into a mold.

FIG. 4 shows pictorially the arc tube operatively positioned in respect of pinch sealing jaws.

FIG. 5 shows the core parts of the jaws at the instant of closure on the arc tube.

DETAILED DESCRIPTION

Referring to FIGS. 1 and 2, an arc lamp 1, more commonly known as an arc tube in the parlance of the art, is shown in which the invention is embodied. In its size and general configuration it is similar to the miniature lamps disclosed in the previously mentioned Cap and Lake patent. Briefly, the arc tube is made from a piece of fused silica or quartz tubing having a hollow bulbous mid-portion 2 which defines an arc chamber for containing a high pressure metal vapor discharge. In this particular instance, the arc chamber is slightly elongated from spherical in the direction of the seals so that it may be described as ellipsoidal and it has a volume of less than one cubic centimeter. The arc chamber may, however, by of various shapes and may be considerably larger than that illustrated. Joined to and extending in diametrically opposite directions from the mid-portion 2 are two flattened seal portions 3 and 4 substantially greater in breadth than in thickness. The seal portions are joined to the bulbous mid-portion by short transitional neck portions 5 and 6 of circular cross section. The cross sectional area of quartz in the necks is not much different from what it is in the flattened seals.

Electrode inlead assemblies 7, 8 extend through the seal and neck portions 3, 5 and 4, 6, respectively, into bulb 2. The lamp illustrated in FIGS. 1 and 2 intended for unidirectional current operation and it is shown in the attitude in which it would normally be operated, that is vertical with the cathode uppermost. The upper electrode inlead assembly terminates in a cathode formed by a tungsten wire or shank 9 having a coil of tungsten wire 11 wound around its distal end. The shank 9 is welded to a molybdenum foil portion 12 which extends through the flattened portion 3 and has a molybdenum lead wire 13 attached to its other end and projecting externally. The cathode may include an electron emitter such as $ThO_2.Y_2O_3$ coating the turns of the helix 11 or filling the interstices between the turns and the shank. For the anode, a tungsten shank 14 terminated by a balled end 15 suffices; the shank is welded to a molybdenum foil portion 16 extending through the flattened portion 4 and having a molybdenum lead 17 attached to its other end and projecting externally.

A typical miniature metal halide arc tube intended for a lamp of 35 watt size may utilize an ellipsoidal bulb as illustrated having a discharge volume from 0.1 to 0.15 cc. By way of example, the bulb may be ½ millimeter in wall thickness, 7 mm in outer diameter, 6 mm internal diameter and 7 mm internal length disregarding irregularities. A suitable filling for the envelope comprises argon or other inert gas at a pressure of several tens of torr to serve as a starting gas and a charge comprising mercury and the metal halides NaI, $ScI_3$ and $ThI_4$. The charge may be introduced into the arc chamber through the side exhaust tube 18 shown in FIGS. 4 and 5, which is then tipped off as shown at 18' in FIGS. 1 and 2. To make a complete lamp, the arc tube is usually mounted within an outer protective envelope or jacket (not shown), which is either evacuated or filled with an inactive gas and provided with a base having contact terminals to which the external leads 13, 17 are connected. Alternatively, where the arc tube is intended as part of a complete lighting unit, an electronic current regulator is attached to the outer envelope and a screw base suitable for the entire unit is provided.

The invention achieves its objective of a low absorptive cross section and avoidance of fin-effect by providing the transitional neck portions 5, 6 between the rounded or conical ends of the bulb and the flattened seal portions 3, 4. Preferably, these neck portions are formed as part or incident in the blowing of the bulb out of quartz tubing, and suitably through the use of an appropriate mold cavity. As illustrated in FIG. 3, a piece of quartz tubing 21 having a length somewhat greater than the length of the finished arc tube is loaded into a glass lathe and seized in headstock and tailstock collets 22, 23. Each collet includes an air coupling device (not shown) to alloy the tubing to be pressurized at the appropriate time. As the tube is rotating in the lathe, intense gas flames are played about its midpoint until a viscous condition is achieved. Then in rapid sequence, rotation is stopped, the gas burners are withdrawn, mold halves 24, 25 are advanced and closed about the tubing as indicated by the arrows, and the tubing is pressurized to expand it into the mold. The expansion of the tubing causes a reduction in wall thickness in the bulb portion 2, but the wall thickness is not reduced and in fact may be increased at the neck portions 5, 6. The throat or passage through the neck may be just barely large enough to permit the electrode to be passed through it. By so doing, the extent to which the electrode may be offset or may lean to one side or the other prior to sealing is quite limited and much greater accuracy in locating and centralizing the electrodes within the bulb is achieved. An exhaust tube 18 is next attached to the bulb, suitably by laser-piercing a hole in the bulb and then heat-softening the quartz about the hole and joining the softened end of the tubing to it.

For the pinching operation, the bulb is supported by the exhaust tube in a vertical attitude with the seal portion 3 lowermost and in line with the pinching jaws 26, 27 as shown in FIG. 4. An electrode inlead assembly, suitably assembly 7 which includes the cathode 9, is inserted into the seal portion and held in place by a holder (not illustrated) providing precisely the desired penetration. The narrow throat through the neck assures that the electrode is substantially on axis and centralized within the bulb. By way of example the diameter of the throat through the neck may be 0.030" when an electrode having a shank of 0.009" is provided. An inactive gas, suitably nitrogen is supplied to the exhaust tube 18 by suitable means represented by the tubing 28. The nitrogen flows into the bulb and through the seal portion up to the moment of pinching to prevent oxidation of the electrodes and leads. The seal portion 3 is heated by a pair of opposed burners (not shown) feeding mixed jets of hydrogen and oxygen whose flames envelop it.

At the conclusion of the heating cycle the seal portion is white hot and plastic starting at the neck 5. At the appropriate moment the burners are rapidly withdrawn and simultaneously the pinching jaws 26, 27 are actuated and brought together by movement of the levers 30, 31 to whose facing ends the jaws are attached. Apoaratus for effecting coordinated simultaneous movement of burners and jaws is known and is disclosed for instance in U.S. Pat. No. 2,857,712—Yoder. The jaws conventionally comprise flat face portions which compress and flatten the quartz about the inlead foil to make the hermetic seal; flat face portion 32 of jaw 26 is seen in FIG. 4. But in addition one of the jaws, 26 in the illustration, includes a pair of prongs 33, 34 located just above and on each side of the flat portion 32 and extending in the direction of the opposite jaw. The prongs encompass and engage the neck portion 5 of the arc tube during the mutual advance of the jaws. The engagement of the neck by the prongs 33, 34 assures accurate location of the bulb and of the seal portion between the pinching jaws at the critical movement, a necessary precedent to accuracy in interelectrode gap length. As the jaws close together, the curved base portion 35 of jaw 26, together with the immediately adjacent portions of the prongs 33, 34 and the cooperating curved portion 36 on opposite jaw 27, form an approximately circular band or collar which encircles the neck 5 at the moment of pinching. In FIG. 5, the neck is shown so encircled except for the prongs 33, 34 which have been omitted to make the illustration clearer. The collar so formed maintains the general configuration of the neck and at the same time squeezes and shrinks it slightly to close the gap or clearance where the electrode shank passes through the throat of the neck. Thus the internal configuration in the end of the arc chamber approximates a surface of revolution around the longitudinal axis of the lamp. However the hermetic seal proper is made at the foil 12 when the jaws momentarily press the quartz against it on both sides.

The arc tube may next be inverted in its holder as shown in FIG. 5, and the pinch or press seal of the anode inlead assembly at the other end made in the same fashion. The manufacture of the arc tube is then completed in conventional fashion which involves exhaust and flush of the sealed arc tube, insertion of mercury and metal halides, introduction of inert starting gas such as argon at appropriate pressure, and finally tipping off the exhaust tube as shown in FIGS. 1 and 2.

What I claim as new and desire to secure by Letters Patent of the United States is:

1. An arc lamp comprising:

a vitreous envelope having a bulbous mid-portion defining an arc chamber and flattened seal portions extending in diametrically opposite directions therefrom, a pair of electrodes located in the bulbous portion each attached to an inlead extending through a seal portion, and substantially cylindrical solid neck portions in said envelope providing transition zones between the rounded ends of the bulbous portion and the flattened seal portions, said transition zones assuring an internal configuration in the ends of the arc chamber which approximates a surface of revolution around the longitudinal axis of the lamp.

2. A lamp as in claim 1 wherein each inlead includes a foil portion to which a hermetic seal is made in the flattened seal portion.

3. A lamp as in claim 1 wherein the throat or passage through each neck is shrunk about the inlead extending through it.

4. A lamp as in claim 1 wherein the throat or passage through each neck prior to sealing was not much greater in size than required to pass the appropriate electrode through it, and after sealing is shrunk about the inlead extending through it.

5. A metal vapor arc lamp comprising:

a vitreous envelope having a bulbous mid-portion defining an arc chamber and flattened seal portions extending in diametrically opposite directions therefrom, a pair of electrodes located in the ends of said bulbous portion each attached to an inlead extending through a seal portion, the inlead including a foil portion making a hermetic seal with the vitreous material of the seal portion pressed about it, and a pair of substantially cylindrical solid neck portions in said envelope providing transition zones between the rounded ends of the bulbous portion and the flattened seal portions, said transition zones assuring an internal configuration in the ends of the arc chamber which approximates a surface of revolution about the longitudinal axis of the lamp whereby to achieve a low absorptive cross section and avoid fin-effect in said lamp.

6. A lamp as in claim 5 wherein the throat or passage through each neck is shrunk about the inlead extending through it.

7. A lamp as in claim 5 wherein the throat or passage through each neck prior to sealing was not much greater in size than required to pass the appropriate electrode through it, and after sealing is squeezed about the inlead extending through it.

8. A lamp as in claim 5 wherein the arc chamber contains an arc-supporting charge comprising mercury and metal halides in excess of the quantity vaporized in operation.

* * * * *